United States Patent [19]

Laitio et al.

[11] 4,306,681

[45] Dec. 22, 1981

[54] BARREL AND FUEL INJECTOR UTILIZING THE SAME

[76] Inventors: Peter A. J. Laitio, 2041 W. 164 St., Torrance, Calif. 90504; Melvin F. Tinker, 11832 Roseglen, El Monte, Calif. 91732

[21] Appl. No.: 123,441

[22] Filed: Feb. 21, 1980

[51] Int. Cl.[3] ..... F02M 47/02

[52] U.S. Cl. ..... 239/89; 239/533.3

[58] Field of Search ..... 239/89, 88, 92, 90, 239/91, 533.1, 533.2, 533.3, 533.4, 533.5, 533.6, 533.7, 533.8, 533.9, 533.11, 533.12, 452, 584

[56] References Cited

U.S. PATENT DOCUMENTS

| | | | |
|---|---|---|---|
| 2,984,230 | 5/1961 | Cummins | 239/89 X |
| 3,351,288 | 11/1967 | Perr | 239/90 X |
| 3,669,360 | 6/1972 | Knight | 239/533.3 |
| 3,737,100 | 6/1973 | Dreisin | 239/89 |
| 3,831,846 | 8/1974 | Perr et al. | 239/89 |

*Primary Examiner*—Robert B. Reeves
*Assistant Examiner*—Gene A. Church
*Attorney, Agent, or Firm*—Gordon L. Peterson

[57] ABSTRACT

A fuel injector comprising a housing, a barrel within the housing and a nozzle member attached to one end of the housing. The barrel has a plunger bore and opposite end faces. The barrel also has an inlet passage leading from a first of the barrel end faces to the plunger bore and an outlet passage leading from the plunger bore to one of the barrel end faces. The inlet passage has an inlet passage leg and first and second axially spaced generally transverse legs extending from the inlet passage leg to the plunger bore and terminating in a spill port and a metering port, respectively, at the plunger bore. The outlet passage has an outlet passage leg and a transverse leg opening at a drain port at the plunger bore and extending to the outlet passage leg. At least one of the inlet passage leg and the outlet passage leg is inclined as it extends toward the associated transverse leg.

12 Claims, 5 Drawing Figures

21
23
13
43
11
41
25
19
37
51
27
29
49
47
39
35
45
57
31
109
33
35
15
101
61
105
53
99
59
97
91
89
17
63
65
32
67

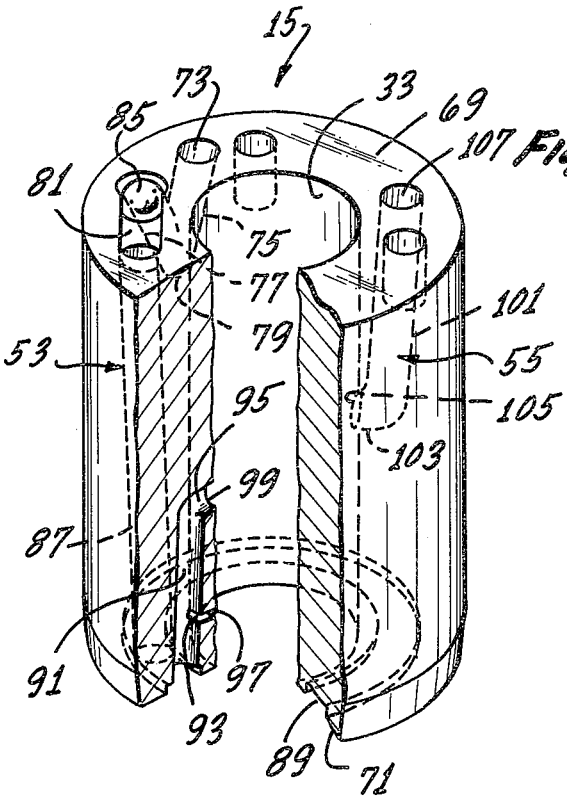
Fig. 2
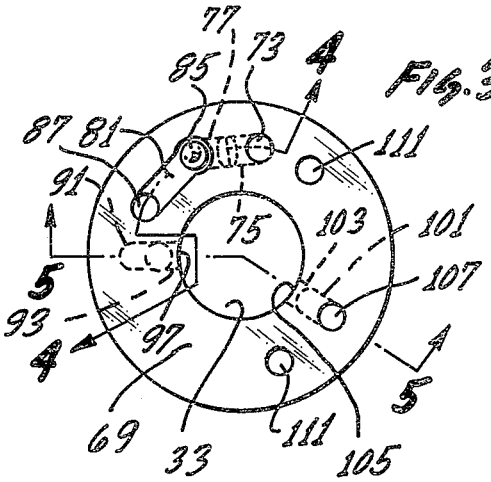
Fig. 3
Fig. 4
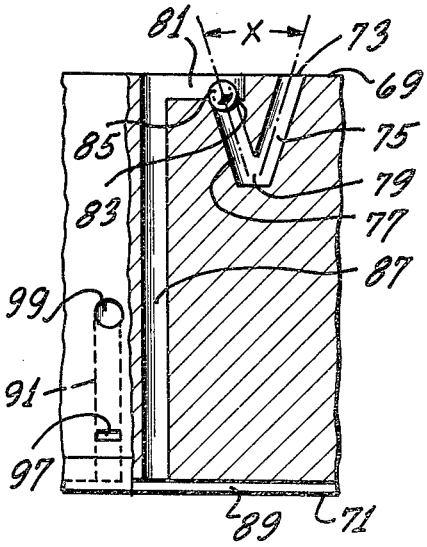
Fig. 5
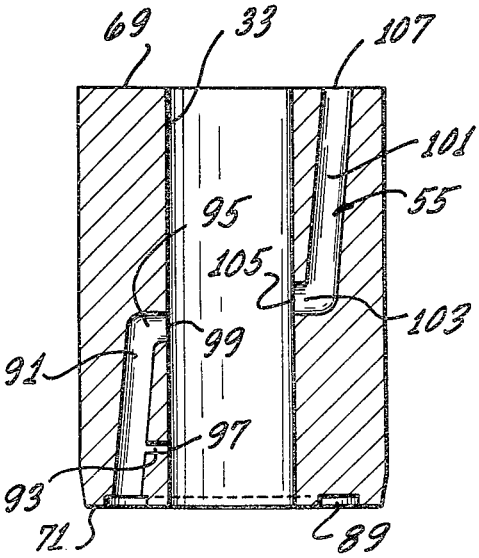

BARREL AND FUEL INJECTOR UTILIZING THE SAME

BACKGROUND OF THE INVENTION

Fuel injectors are used for injecting fuel into the combustion chambers of internal combustion engines. For example, fuel injectors are commonly used to inject fuel into the combustion chambers of diesel or compression ignition engines.

This invention relates to a barrel-type fuel injector, i.e., a fuel injector which includes a barrel. Barrel-type fuel injectors are shown by way of example in Perr U.S. Pat. No. 3,351,288 and Perr et al U.S. Pat. No. 3,831,846.

A barrel-type fuel injector typically includes a housing, a barrel within the housing and a nozzle member attached to one end of the housing. The barrel has a plunger bore, inlet passage means leading to the plunger bore and outlet passage means leading away from the plunger bore. A plunger is mounted for reciprocating movement within the housing and the plunger bore. The plunger controls the flow of fuel from the inlet passage means into the plunger bore as a function of the axial position of the plunger. In addition, the plunger forces fuel through spray holes of the nozzle member into the combustion chamber.

SUMMARY OF THE INVENTION

The field of fuel injectors is highly developed, and considerable work has been done with a view toward improving the injector in a way that will improve engine performance and efficiency. This invention provides certain improvements in the barrel which result in a significant improvement in brake specific fuel consumption, brake horsepower and peak torque. For example, one laboratory test showed a reduction of approximately 23 percent in brake specific fuel consumption of a rebuilt diesel engine equipped with the fuel injectors of this invention as compared with using Cummins' rebuilt injectors.

The barrel of this invention includes a tubular member having a generally axial plunger bore extending through the tubular member, a wall circumscribing the plunger bore and first and second end faces on the wall. The wall has inlet passage means leading from a first of the end faces to plunger bore and outlet passage means leading from the plunger bore to one of the end faces. The inlet passage means includes an inlet passage leg and first and second axially spaced generally transverse legs extending from the inlet passage leg to the plunger bore and terminating in a spill port and a metering port, respectively, at the plunger bore. The outlet passage means includes an outlet passage leg and a transverse leg opening at a drain port at the plunger bore and extending to the outlet passage leg.

One feature of this invention is that either or both of the inlet passage leg and the outlet passage leg are appropriately inclined. Specifically, at least one of the inlet passage leg and the outlet passage leg is inclined radially inwardly as it extends axially toward at least one of the transverse legs with which such one leg is associated. Preferably, both of the inlet passage leg and the outlet passage leg are inclined as described above.

One consequence of inclining the inlet passage leg and the outlet passage leg is that the transverse legs associated therewith are inherently shortened as a result of such inclination. This facilitates the forming of the transverse legs and, as such, provides manufacturing and cost advantages.

More importantly, however, it is believed that the inclining of the inlet passage leg and the outlet passage leg contributes to the improved fuel economy noted hereinabove. The reason for the relationship between the inclination and fuel economy is not known with certainty. However, it is believed that the inclination and the reduced lengths of the transverse passages reduces the turbulence of the fuel flowing through these passages. In this regard, the inclination of the inlet and outlet passage legs reduces the angle through which the fuel must turn and, as indicated above, reduces the lengths of the transverse legs. By reducing turbulence, the fuel volume for each injection stroke is made more predictable and more constant from stroke to stroke.

The metering port is the port through which fuel is metered into the plunger bore of the barrel. It is known to make this port in the configuration of a rectangle or other parallelogram extending axially to tend to provide a more linear relationship between the axial position of the plunger as it covers and uncovers a metering port and fuel flow through the metering port. This invention uses this principle but also provides that the height dimension of the metering port should not exceed about 0.035 inch for type D top stop injectors and 0.025 inch for type D injectors and in both cases, should be less than the base or width dimension of the port. By reducing the height dimension of the metering port in this fashion, a much sharper cut off of the flow of fuel into the plunger bore is obtained. Also, by increasing the base dimension of the metering port, the total area of the metering port can be maintained essentially equal to the conventional cross-sectional area of the metering port for a particular injector.

The barrel of this invention has a barrel inlet at the first end face of the barrel, and the usual check valve is provided between the barrel inlet and the inlet passage leg. To accommodate the check valve, it is common practice to have a "U" or channel-shaped section of the inlet passage means immediately adjacent the barrel inlet. However, with this invention, the check valve is accommodated by a first straight bore which extends from the barrel inlet into the wall of the barrel and a second straight bore intersecting the first straight bore and extending back generally toward the first end face. The second straight bore terminates in a valve seat for the check valve.

In order for the two straight bores to be oriented as described above and to intersect, it is necessary that they be inclined relative to each other, and a "V" configuration is preferred. It is believed that this "V" configuration also reduces turbulence of the fuel and inherently provides a larger cross-sectional area for the intersection of the two straight bores than would exist at the corners of the conventional "U"-shaped passage construction. This construction, as well as the inclined inlet and outlet passage legs described above, eliminates the need for plugs in the barrel. The elimination of plugs eliminates the possibility of leakage at the regions which would otherwise be plugged.

The invention, together with further features and advantages thereof, may best be understood by reference to the following description taken in connection with the accompanying illustrative drawing.

BRIEF DESCRIPTION OF THE DRAWING

FIG. 2 is an isometric view with portions cut away of a barrel constructed in accordance with the teachings of this invention.

FIG. 3 is a top plan view of the barrel.

FIG. 4 is a fragmentary sectional view taken generally along line 4—4 of FIG. 3.

FIG. 5 is a sectional view taken generally along line 5—5 of FIG. 3.

DESCRIPTION OF THE PREFERRED EMBODIMENT

Figure 1:
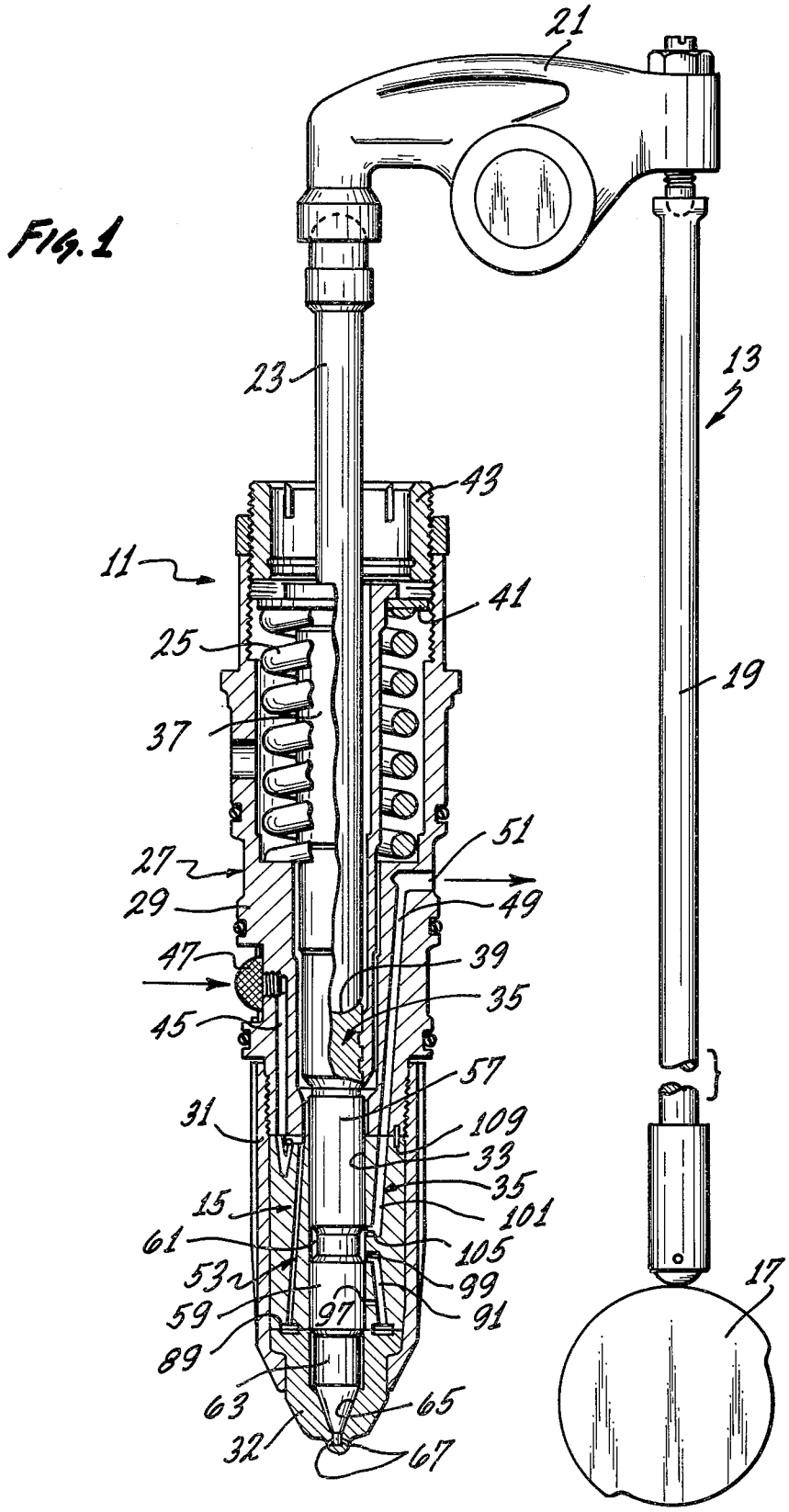
FIG. 1 is a schematic elevational view of a fuel injector constructed in accordance with the teachings of this invention and the associated plunger operating means. The injector is shown in longitudinal cross-section, and the passages are shown schematically.

FIG. 1 shows a fuel injector 11 and plunger operating means 13. The fuel injector 11 includes a barrel 15, and except for the barrel 15, the fuel injector 11 and the plunger operator means 13 may be of conventional construction.

The plunger operating means 13 includes an engine-driven rotatable cam 17, a push rod 19, a pivotally mounted rocker arm 21 and a link arm 23 which extends into the fuel injector 11. Rotation of the cam 17 reciprocates the push rod 19 to oscillate the rocker arm 21, and the rocker arm reciprocates the link arm 23. A spring 25 of the injector 11 biases the link arm 23 upwardly as described more particularly hereinbelow.

Although the fuel injector 11 could be of various different constructions, in the embodiment illustrated, it may be a "D" type Cummins top stop injector which forms a part of, for example, an AFC or PT Cummins fuel system. The fuel injector 11 includes a housing 27 comprised of a housing section 29 and a cup retainer 31 threaded onto the housing section 29. A cup or nozzle member 32 is mounted at the lower end of the cup retainer 31. The barrel 15 has a plunger bore 33, and the injector 11 includes a plunger 35 mounted for reciprocation in the housing 27 and the plunger bore 33. The plunger 35 has an upper tubular section 37 which receives the link arm 23 with the link arm 23 bearing against a surface 39 of the plunger. The spring 25 acts between a shoulder on the housing section 29 and a washer 41 carried on the upper end of the plunger 35 to resiliently bias the plunger and the link arm 23 upwardly. Accordingly, the axial position of the plunger 35 is controlled by the link arm 23 and the plunger operating means 13. A top stop screw or bushing 43 is threadedly received in the upper end of the housing section 29 and forms a stop for the upper limit of travel of the washer 41 and hence of the plunger 35.

Fuel is supplied to the injector 11 from a source (not shown) to inlet conduit means 45 in the housing section 29 which lead from the periphery of the housing section 29 to the barrel 15. The usual screen and orifice 47 may be provided at the inlet of the inlet conduit means 45. Return or outlet conduit means 49 in the housing section 29 lead from the barrel 15 to an outlet 51 at the periphery of the housing section 29. The outlet 51 returns fuel to the fuel source. The barrel 15 has inlet passage means 53 which leads from the inlet conduit means 45 to the plunger bore 33 and return or outlet passage means 55 which leads from the plunger bore 33 to the outlet conduit means 49.

The flow of fuel into and out of the plunger bore 33 is controlled by the plunger 35 which has lands 57 and 59, a groove 61 and reduced diameter portion 63 for this purpose. In addition, the plunger on its down stroke can force fuel from a well 65 in the nozzle member 32 out through spray holes 67 of the nozzle member 32 and into the combustion chamber of the engine, such as a compression ignition engine, with which the fuel injector 11 is being utilized.

The inlet passage means 53 and the outlet passage means 55 are shown schematically in FIG. 1. FIGS. 2–5 show the actual construction of one embodiment of the barrel constructed in accordance with the teachings of this invention.

With reference to FIGS. 2–5, the barrel 15 is in the form of a cylinder, and the plunger bore 33 is also cylindrical and extends axially completely through the barrel. The barrel 15 has annular end faces 69 and 71 which lie in radial planes.

As shown in FIGS. 2–5, the inlet passage means 53 includes various sections and ports. Thus, the inlet passage means 53 has a barrel inlet 73 opening at the end face 69. A straight bore 75 (FIGS. 2 and 4) extends from the barrel inlet 73 into the wall of the barrel, and a second straight bore 77 intersects the bore 75 and extends back generally toward the end face 69. In the embodiment illustrated, the bores 75 and 77 are cylindrical and of the same diameter. In the embodiment illustrated, the bores 75 and 77 are drilled, and each of them is inclined at a 20-degree angle to the longitudinal axis of the plunger bore 33. The axes of the bores 75 and 77 form an included angle X which, in the embodiment illustrated, is 40 degrees. The bores 75 and 77 form a generally "V"-shaped passage section and have a region of intersection 79 which has a greater cross-sectional area than either of the bores 75 and 77.

The straight bore 77 opens into a groove 81 in the end face 69, and the juncture of the bore 77 and the groove 81 defines a valve seat 83. A valve element in the form of a ball 85 is provided in the groove 81 and the bore 77 for cooperation with the valve seat 83 to form a check valve which prevents reverse flow through the barrel 15 and out the barrel inlet 73.

Also forming portions of the inlet passage means 53 are a vertical transfer bore 87 and an annular groove 89 formed in the end face 71. The groove 81 terminates in the transfer bore 87, and the transfer bore is preferably cylindrical and extends axially to the groove 89.

The inlet passage means 53 also includes an inlet passage leg 91 and first and second axially spaced transverse legs 93 and 95 extending from the inlet passage leg to the plunger bore 33. The transverse legs 93 and 95 terminate in a metering port 97 and a spill port 99, respectively.

The transverse leg 93 lies intermediate the transverse leg 95 and the end face 71. The inlet passage leg 91 extends from the groove 89 to the transverse legs 93 and 95. The inlet passage leg 91 is in the form of a cylindrical passage which extends radially inwardly as it extends from the groove 89 to both of the transverse legs 93 and 95.

The axes of the transverse legs 93 and 95 preferably extend radially. The metering port 97 and the cross section of the transverse leg 93 are rectangular as shown in FIG. 4 with the base of the rectangle extending transverse to the axis of the plunger bore 33 and with the height dimension of the rectangle extending axially. The height dimension of the metering port 97 is 0.035 inch, and the base or width dimension is 0.070 inch. The spill port 99 and the cross section of the transverse leg 95 are preferably circular and may have the same diameter as the inlet passage leg 91.

The outlet passage means 55 includes an outlet passage leg 101 (FIGS. 2 and 5) and a transverse leg 103 opening at a drain port 105 at the plunger bore 33 and extending to the outlet passage leg. The outlet passage leg 101 opens at a barrel outlet 107 at the end face 69. The outlet passage leg 101 and the transverse leg 103 may be cylindrical and be of the same diameter, with the bottom of the drain port 105 being essentially tangent to a radial line which is tangent to the top of the spill port 99. The outlet passage leg 101 is inclined radially inwardly as it extends from the barrel outlet 107 to the transverse leg 103. For example, the axes of the inlet passage leg 91 and the outlet passage leg 101 may each be inclined inwardly about 5.5 degrees relative to the axis of the plunger bore 33.

Both the inlet passage leg 91 and the outlet passage leg 101 are straight cylindrical bores and may be drilled. The short transverse legs 93, 95 and 103 may be formed by an electrical discharge machine. Dowels 109 (FIG. 1) are received in blind bores 111 and in corresponding bores in the housing section 29 to properly index the barrel 15 relative to the housing section 29 so as to align the inlet conduit means 45 and the outlet conduit means 49 with the barrel inlet 73 and the barrel outlet 107, respectively.

The fuel injector 11 is operated in a well-known manner by reciprocating the plunger 35 with the plunger operating means 13. In the position shown in FIG. 1, the plunger 35 is in a scavenging position at the bottom of its stroke. In this position, fuel is supplied from the inlet conduit means 45 through the inlet passage means 53, the spill port 99, the groove 61, the drain port 105, the outlet passage means 55 and the outlet conduit means 49 to the outlet 51 of the injector 11. The metering port 97 is closed by the land 59 of the plunger 35. The plunger 35 is in the scavenging position during all of the exhaust and power strokes and for portions of the intake and compression strokes of the engine.

After the cam 17 rotates to a predetermined position, the spring 25 can begin moving the plunger 35 upwardly as permitted by the cam 17 to a metering position in which the reduced diameter portion 63 confronts the metering port 97 to open the latter whereupon fuel can flow into the plunger bore 33 below the land 59 and into the well 65. At this time, the land 59 covers and closes the spill port 99. The plunger 35 is in the metering position during portions of the intake and compression strokes of the engine.

Upon further rotation of the cam 17, the plunger 35 is forced downwardly to a preinjection position in which the metering port 97 is closed by the land 59 and the spill port 99 is closed with that same land. Continued downward movement of the plunger 35 causes the lower end of the plunger to force the fuel from the well 65 through the spray holes 67 into the combustion chamber, and this is referred to as injection. During injection, fuel supplied in the inlet passage means 53 passes through the spill port 99, the groove 61, the drain port 105 and the outlet passage leg 101 of the barrel 15. During injection, the metering port 97 remains closed substantially as shown in FIG. 1. During injection, the spill port 99 is only partly closed by the land 59. Preinjection and injection occur during the compression stroke.

With reference to FIGS. 2–5, it is believed that losses and turbulence are reduced by the inclined straight bores 75 and 77 and the relatively large region of intersection 79 as compared with the conventional "U" or channel-shaped construction at this location. The inclination of the inlet passage leg 91 and the outlet passage leg 101 reduces the lengths of the transverse legs 93, 95 and 103. In addition, it is believed that this contributes to a reduction in losses and turbulence and promotes efficient injection of accurately known fuel quantities on each cycle of reciprocation of the plunger 35. The small vertical dimension of the metering port 97 permits the land 59 of the plunger 35 to rapidly open and close the metering port to abruptly start and stop the supply of fluid to the plunger bore 33 below the land 59. A construction substantially as shown herein was the one which showed in laboratory tests an approximate 23 percent improvement in brake specific fuel consumption as compared with a standard Cummins rebuilt engine and rebuilt injector.

Although an exemplary embodiment of the invention has been shown and described, many changes, modifications and substitutions may be made by one having ordinary skill in the art without necessarily departing from the spirit and scope of this invention.

We claim:

1. A barrel for a fuel injector comprising:

a tubular member having a generally axial plunger bore extending through said tubular member, a wall circumscribing the plunger bore, and first and second opposite end faces on said wall;

said wall having inlet passage means leading from said first end face to said plunger bore;

said inlet passage means including an inlet passage leg and first and second axially spaced generally transverse legs extending from said inlet passage leg to said plunger bore and terminating in a spill port and a metering port, respectively, at said plunger bore;

said wall having outlet passage means leading from said plunger bore to one of said end faces;

said outlet passage means including an outlet passage leg and a transverse leg opening at a drain port at the plunger bore and extending to said outlet passage leg; and at least one of said inlet passage leg and said outlet passage leg being inclined radially inwardly as it extends axially toward at least one of the transverse legs with which such one leg is associated.

2. A barrel as defined in claim 1 wherein said one leg is said inlet passage leg.

3. A barrel as defined in claim 1 wherein said one leg is said outlet passage leg.

4. A barrel as defined in claim 3 wherein the inlet passage leg is inclined radially inwardly as it extends from a location on the side of the second transverse leg remote from the first transverse leg to said first transverse leg.

5. A barrel as defined in claim 1 wherein said metering port is in the shape of a parallelogram having base and height dimensions with the height dimension extending generally axially of the plunger bore and being no greater than about 0.035 inch, said height dimension being less than said base dimension.

6. A barrel as defined in claim 1 wherein said inlet passage means has a barrel inlet at said first end face, a first straight bore extending from the barrel inlet into said wall and a second straight bore intersecting the first straight bore and extending back generally toward said first end face, said second straight bore terminating in a valve seat.

7. A barrel as defined in claim 6 wherein the inlet passage means includes a groove in said second end face and an inlet passage section connecting said valve seat and said groove, said metering port being axially intermediate the groove and the spill port, said one leg is said inlet leg and said inlet leg is inclined radially inwardly as it extends from said groove to said first transverse leg, said barrel having a barrel outlet at said first end face, said outlet passage leg being inclined radially inwardly as it extends from said barrel outlet to the transverse leg of the outlet passage means, and said metering port is in the shape of a parallelogram having base and height dimensions with the height dimension extending axially and being smaller than the base dimension.

8. A fuel injector for injecting fuel into a combustion chamber of an internal combustion engine comprising:

an injector housing;

a nozzle member coupled to the injector housing at one end of the housing, said nozzle member having spray holes for spraying fuel into the combustion chamber;

a barrel in said housing adjacent said nozzle member, said barrel having a generally axial plunger bore extending through said barrel, a wall circumscribing the plunger bore, a first end face on said wall remote from the nozzle member and a second end face adjacent the nozzle member;

a plunger extending into said injector housing and into said plunger bore of said barrel;

means for mounting said plunger for axial reciprocating movement in said housing and said plunger bore;

inlet conduit means for conducting fuel to the barrel;

outlet conduit means for conducting fuel from the barrel;

said wall having inlet passage means leading from said inlet conduit means to said plunger bore and outlet passage means leading from said plunger bore to said outlet conduit means;

said inlet passage means including an inlet passage leg and first and second axially spaced generally transverse legs extending from said inlet passage leg to said plunger bore and terminating in a spill port and a metering port, respectively, at said plunger bore;

said outlet passage means including an outlet passage leg and a transverse leg opening at a drain port at the plunger bore and extending to said outlet passage leg;

at least one of said inlet passage leg and said outlet passage leg being inclined radially inwardly as it extends axially toward at least one of the transverse legs with which such one leg is associated; and said plunger controlling the flow of fuel from the metering port and the spill port into said plunger bore and the injection of fuel through said spray holes as a function of the axial position of said plunger within said housing.

9. A fuel injector as defined in claim 8 wherein said one leg is said outlet passage leg.

10. A fuel injector as defined in claim 8 wherein said one leg is said inlet passage leg, said inlet passage leg extends from a location adjacent said nozzle member toward said first and second transverse legs, said inlet passage leg being inclined radially inwardly as it extends from said location toward said first and second transverse legs.

11. A fuel injector as defined in claim 8 wherein said metering port is in the shape of a parallelogram having base and height dimensions with the height dimension extending axially of the plunger bore and being no greater than about 0.025 inch, said base dimension being greater than said height dimension.

12. A fuel injector as defined in claim 8 wherein said inlet passage means has a barrel inlet at said first end face, a first straight bore extending from the barrel inlet into said wall, and a second straight bore intersecting the first straight bore and extending back generally toward said first end face and terminating in a valve seat, and a valve element within the barrel for cooperating with the valve seat.

* * * * *